United States Patent [19]

Takagi

[11] 4,275,947

[45] Jun. 30, 1981

[54] PLUG FOR ELECTRIC CONNECTIONS

[75] Inventor: Taketoshi Takagi, Tokyo, Japan

[73] Assignee: Japan Music Supply Inc., Tokyo, Japan

[21] Appl. No.: 59,166

[22] Filed: Jul. 20, 1979

[30] Foreign Application Priority Data

Aug. 18, 1978 [JP] Japan ..... 53/112575[U]

[51] Int. Cl.[3] ..... H01R 17/18; H01R 33/54

[52] U.S. Cl. ..... 339/183; 200/51.09; 339/14 P

[58] Field of Search ..... 339/14 P, 182 R, 182 RS, 339/183, 177 R, 177 E; 179/1 PC, 107, 91 A, 96; 200/51.09, 51.11, 51.12; 174/75 C

[56] References Cited

U.S. PATENT DOCUMENTS

| | | | |
|---|---|---|---|
| 2,640,118 | 5/1953 | Werner | 174/75.2 X |
| 2,664,475 | 12/1953 | Harlin | 339/14 R X |
| 3,467,940 | 9/1969 | Wallo | 339/14 R |
| 3,600,531 | 8/1971 | Hoegeal | 339/177 E X |

*Primary Examiner*—Eugene F. Desmond

*Attorney, Agent, or Firm*—Frishauf, Holtz, Goodman and Woodward

[57] ABSTRACT

A connector plug includes a tip contact having a center lead rod, a cylindrical side contact coaxially located around the center lead rod, and insulation members for electrically isolating the tip and side contacts from each other. Also disclosed is a spring loaded arrangement for short circuiting the center lead rod to the side contact when the plug is out of a jack, and which automatically releases the short circuit when the plug is completely inserted into a jack.

5 Claims, 4 Drawing Figures

PLUG FOR ELECTRIC CONNECTIONS

BACKGROUND OF THE INVENTION

The present invention relates to a connector plug, and more particularly to an improved connector plug for coaxial cables used in an electric sound device to prevent objectionable noise generation during insertion or withdrawal of the plug from a jack.

In the prior art, a plug for electrical connections generally comprises a tip contact member having a center lead rod, a cylindrical side contact member coaxially located relative to the center lead rod, and insulation members by means of which the contact members are mutually electrically isolated.

If the prior art plug is inserted into or pulled from a jack of the electric sound device during electro-music performance, with the contact member of positive polarity accidentally touching a part of the sound device, the sound unavoidably includes touch noises, thereby causing the performance to be degraded.

An object of this invention is to provide a plug for electrical connections so improved as to prevent the noise infiltration to the sound circuit during insertion or withdrawal of the plug from a jack, thereby improving the performance.

SUMMARY OF THE INVENTION

In accordance with the invention, a connector plug for insertion into a jack includes a tip contact member having an elongated center lead rod extending therefrom, a cylindrical side contact member coaxially located around the center lead rod, and insulation means for electrically isolating the tip contact from the side contact. The plug further comprises a contactor electrically connected to the center lead rod; a relief member electrically coupled to the cylindrical side contact member and movable between a first position in which the relief member electrically contacts the contactor and a position in which the relief member is out of electrical contact with the contactor; and bias means for biasing the relief member toward the first position of the relief member; the relief member having a forward end which is adapted to be forcedly pushed by an outer edge of a jack to cause the relief member to move to a position out of electrical contact with the contactor when the plug is inserted into the jack.

DETAILED DESCRIPTION

Figure 3:
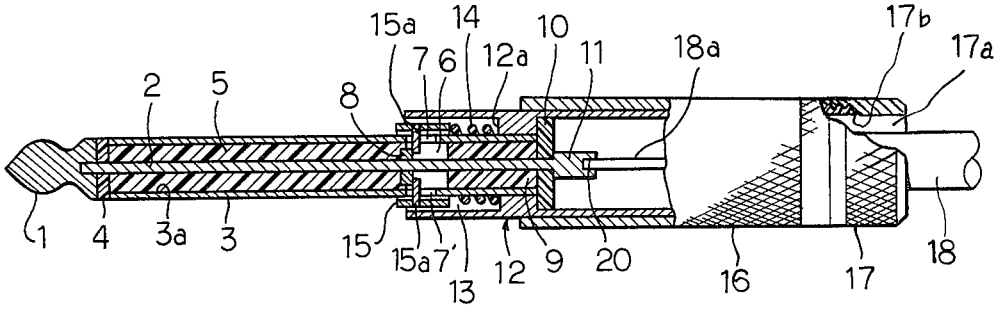
FIG. 3 is a vertical cross-section of the plug of FIG. 1.

Referring to the drawings, a plug embodying this invention includes a tip contact member 1 serving as a positive pole, the tip member 1 having a generally conical shape and having a center lead rod 2 (FIG. 3). A cylindrical side contact member 3 is coaxially located around the center lead rod 2, and insulation members 4 and 5 are provided to electically isolate the contact members 1 and 3 from each other. Insulation member 4 is a ring-shape spacer between the base end of the tip member 1 and the tip end of coaxial member 3, and the other insulation member 5 is located between the inner hollow 3*a* formed in the coaxial member 3 and the center lead rod 2. The center lead rod 2 is inserted through the insulation member 5 and at the tip end is electrically connected with the tip member 1.

Figure 4:
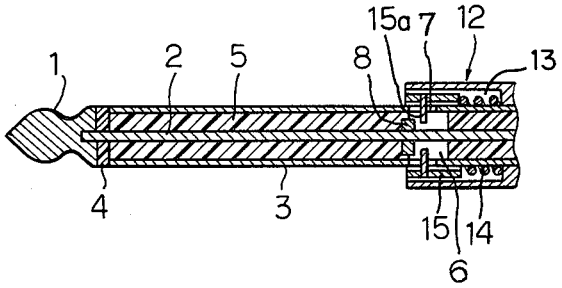
FIG. 4 is a vertical cross-section of the plug in a condition in which the plug is completely inserted into a jack.

As seen in FIGS. 3 and 4, the cylindrical side contact member 3 further includes a hollow space 6 having no insulation member therein and positioned at one-third of the distance along the length thereof, and two slits 7 and 7' formed on the periphery thereof and which penetrate through the thickness of contact member 3 into the hollow space 6.

The plug further includes a ring-shaped contactor 8 (FIGS. 3 and 4) embedded in the end of the insulation member 5 and positioned at the forward end of the space 6, a tubular insulation member 9 inserted into the rear portion of the cylindrical member 3 so as to form a rear wall for defining the space 6, and a large diameter ring member 10 attached to the rear ends of the cylindrical member 3 and insulation member 9 and engaged with a flange or enlargement 11 formed at the rear end of the center lead rod 2.

The member covering the rear portion of the cylindrical member 3 is a plug body 12 used as a negative pole together with the cylindrical member 3. The plug body 12 has a flange 12*a* integrally formed at the interior thereof so as to electrically connect plug body 12 with the rear portion of the cylindrical member 3 and engage to the flange 11. The plug body 12 further includes a closed space 13 formed at the forward portion thereof. The space 13 is used for containing a compression coil spring member 14 and special means 15 which is a relief member for maintaining an electrical connection in the plug body 12 between the contact members 1 and 3 until the plug is completely inserted into a jack.

As seen in FIGS. 3 and 4, the relief member is shaped as a hollow cylinder and has two inner protruding members 15*a*,15*a* which are inserted through the slide slits 7 and 7' within which they are slidable. Protruding members 15*a* are biased by spring 14 (via cylinder 15) to detachably contact the ring-shaped contactor 8 at the tip end of space 6. Contact 8 is connected to lead rod 2.

The relief member 15 is mounted on the cylindrical member 3 before the cylinder is inserted into the plug body 12 and the rod 2 is inserted into the insulation members 5 and 9.

Figure 1:
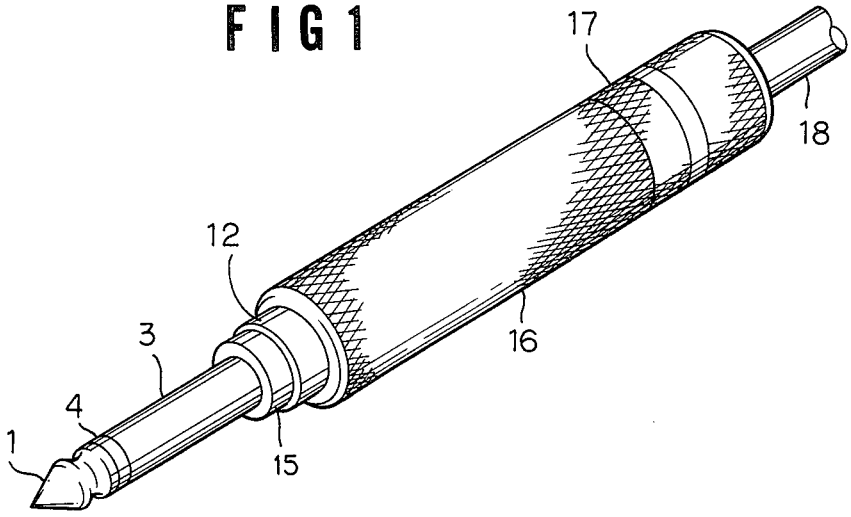
FIG. 1 is a perspective view of the plug embodying this invention.
Figure 2:
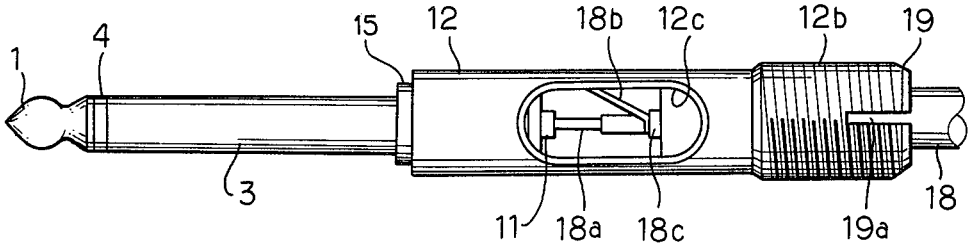
FIG. 2 is a side view of the plug in which plug shanks are removed.

As seen in FIG. 2, the plug body 12 further includes a screw-threaded member 12*b* integrally formed thereto. To the screw member 12*b* are detachably screwed two housing members 16 and 17, one of which is a hollow cylindrical member 16, and the other being a lock member 17 for setting and locking a cable wire 18 to the plug body 12.

The lock member 17 (FIG. 3) includes a through bore 17*a* for inserting the cable wire 18 and a conically tapered wall portion 17*b*. In contradistinction with the tapered wall portion 17*b*, the plug body 12 has a chuck 19 (FIG. 2) formed at the rear portion thereof and which includes slits 19*a*. Accordingly, the tapered wall portion 17*b* pushes the chuck 19 so as to cause the chuck to close tight on the cable wire 18 to thereby firmly clamp the wire 18 to the plug body 12.

As seen in FIGS. 2 and 3, wire 18 is a coaxial lead type wire, and has a central conductor 18*a* extending therealong and which is inserted into a groove hole 20

(FIG. 3) formed at the rear end of the rod 2 and fixed to the rod 2 by means of welding metal. The wire 18 has a joint member 18*b* extending from a lead member 18*c* connected to the outer conductor of the wire 18 so as to contact or engage with the plug body 12 by means of the same type of welding metal as mentioned above.

The welding used to connect members 18*a* and 18*c* to the plug is known. The plug body 12 includes a work hole 12*c* formed at the side portion thereof and through which the welding is performed.

Before insertion into a jack, the plug is in a condition in which the relief member 15 is biased by means of the spring member 14 so that the protruding members 15*a*, 15*a* forcedly contact with the contactor 8, whereby the contactor 8 electrically connects the rod 2 with the cylindrical member 3 via the relief member 15, spring member 14 as well as the plug body 12.

Accordingly, the positive pole is connected to ground, so as to avoid the introduction of noise into the sound circuit of the device when the plug is inserted into or pulled from a jack, or when the positive pole accidentally touches part of the device.

When insertion into the jack is completed, the plug is in another condition in which the relief member 15 recedes rearwardly due to the forward end thereof being forcedly pushed by the outer edge of the jack against the bias of the spring member 14 as shown in FIG. 4, so that the protruding members 15*a* and 15*a* separate from the contactor 8 so as to electrically isolate cylindrical member 3 from the rod 2.

What is claimed is:

1. In a connector plug for insertion into a jack, including a tip contact member having an elongated center lead rod extending therefrom, a cylindrical side contact member coaxially located around said center lead rod, insulation means for electrically isolating said tip contact from said side contact, and a plug body to which said tip and side contact members are mounted, the improvement comprising:

a contactor electrically connected to said center lead rod;

a hollow cylindrical relief member circumferentially surrounding and electrically coupled to said cylindrical side contact member and movable relative to said side contact member between a first position in which said relief member directly electrically contacts said contactor and a position in which said relief member is out of electrical contact with said contactor, at least a portion of said relief member extending outside said plug body when in said first position; and bias means for biasing said hollow cylindrical relief member toward said first position of said relief member to electrically connect together said center lead rod and said side contact member;

said hollow cylindrical relief member having a cylindrical forward end which is adapted to be forcedly pushed by an outer edge of a jack to cause said relief member to move to a position out of electrical contact with said contactor when said plug is inserted into said jack to thereby electrically disconnect said center lead rod from said side contact member.

2. The plug of claim 1 wherein said cylindrical side contact member has at least one slit extending therethrough, and said relief member has at least one protrusion extending through said at least one slit, said at least one slit being formed at the side portion of said cylindrical side contact member, said protrusion being slidable in said slit to directly contact said contactor.

3. The plug of claim 2, comprising a space formed in the cylindrical side contact member, said space being rearward of said contactor relative to said tip contact, said protrusion extending into said space.

4. The plug of claim 3 wherein said plug body defines a further space and said bias means comprises a compression spring in said further space.

5. The plug of claim 1 wherein said bias means comprises a compression spring.

* * * * *